US008500922B2

(12) United States Patent
Ozeki et al.

(10) Patent No.: US 8,500,922 B2
(45) **Date of Patent: *Aug. 6, 2013**

(54) PERMANENT MAGNET AND PROCESS FOR PRODUCING PERMANENT MAGNET

(75) Inventors: Izumi Ozeki, Osaka (JP); Katsuya Kume, Osaka (JP); Junichi Nakayama, Osaka (JP); Yuuki Fukuda, Osaka (JP); Toshinobu Hoshino, Osaka (JP); Tomokazu Horio, Osaka (JP)

(73) Assignee: Nitto Denko Corporation, Osaka (JP)

( * ) Notice: Subject to any disclaimer, the term of this patent is extended or adjusted under 35 U.S.C. 154(b) by 141 days.

This patent is subject to a terminal disclaimer.

(21) Appl. No.: 12/937,803

(22) PCT Filed: Apr. 14, 2009

(86) PCT No.: PCT/JP2009/057531

§ 371 (c)(1),
(2), (4) Date: Oct. 14, 2010

(87) PCT Pub. No.: WO2009/128459

PCT Pub. Date: Oct. 22, 2009

(65) Prior Publication Data

US 2011/0267160 A1 Nov. 3, 2011

(30) Foreign Application Priority Data

Apr. 15, 2008 (JP) ..... 2008-105760

(51) Int. Cl.
*H01F 1/057* (2006.01)

(52) U.S. Cl.
USPC ..... 148/302; 75/244; 148/101; 419/12

(58) Field of Classification Search
USPC ..... 148/101, 302; 75/244; 419/12
See application file for complete search history.

(56) References Cited

U.S. PATENT DOCUMENTS

| | | | | |
|---|---|---|---|---|
| 3,892,599 | A | 7/1975 | Smeggil et al. | |
| 4,601,754 | A * | 7/1986 | Ghandehari | 75/252 |
| 4,776,902 | A | 10/1988 | Ghandehari | |
| 6,159,308 | A * | 12/2000 | Uchida et al. | 148/302 |
| 6,361,738 | B1 | 3/2002 | Kaneko et al. | |

(Continued)

FOREIGN PATENT DOCUMENTS

| | | |
|---|---|---|
| CN | 1559728 A | 1/2005 |
| EP | 0991086 A1 | 4/2000 |

(Continued)

OTHER PUBLICATIONS

English Abstract of Japanese Patent Document No. 03-014204, Jan. 22, 1991.*

(Continued)

*Primary Examiner* — Roy King
*Assistant Examiner* — Timothy Haug
(74) *Attorney, Agent, or Firm* — Sughrue Mion, PLLC

(57) ABSTRACT

The present invention relates to a permanent magnet manufactured by steps of: pulverizing a magnet raw material into fine particles having a grain size of 3 μm or less; mixing the pulverized magnet raw material with a rust preventive oil in which a high-melting metal element-containing organic compound or a precursor of a high-melting ceramic is dissolved, thereby preparing a slurry; compression molding the slurry to form a molded body; and sintering the molded body.

3 Claims, 3 Drawing Sheets

U.S. PATENT DOCUMENTS

| | | | | |
|---|---|---|---|---|
| 6,468,365 | B1 * | 10/2002 | Uchida et al. | 148/302 |
| 2003/0041920 | A1 | 3/2003 | Hoshi et al. | |
| 2007/0245851 | A1 * | 10/2007 | Sagawa et al. | 75/10.67 |

FOREIGN PATENT DOCUMENTS

| | | | |
|---|---|---|---|
| JP | 62-284002 | A | 12/1987 |
| JP | 64-068903 | A | 3/1989 |
| JP | 1-150303 | A | 6/1989 |
| JP | 03-014204 | * | 1/1991 |
| JP | 3-14204 | A | 1/1991 |
| JP | 4-26104 | A | 1/1992 |
| JP | 11-307330 | A | 11/1999 |
| JP | EP 0 991 086 | A1 * | 5/2000 |
| JP | 2002-164239 | A | 6/2002 |
| JP | 2004-250781 | A | 9/2004 |
| JP | 2006-286819 | A | 10/2006 |
| WO | 2005/052960 | A2 | 6/2005 |

OTHER PUBLICATIONS

Extended European Search Report issued on Apr. 18, 2011 in the corresponding European Patent Application No. 09732952.8.

International Search Report for PCT/JP2009/057531 dated Jul. 21, 2009 [PCT/ISA/210].

Written Opinion for PCT/JP2009/057531 dated Jul. 21, 2009 [PCT/ISA/237].

Communication dated Mar. 27, 2012 from the State Intellectual Property Office of P.R. China in a counterpart application No. 200980113303.1.

Office Action dated Dec. 25, 2012, issued by the Japanese Patent Office in counterpart Japanese Application No. 2008-105760.

Communication dated Mar. 28, 2012 issued by the State Intellectual Property Office of the People's Republic of China in Chinese Application No. 200980113298.4.

International Search Report [PCT/ISA/210] issued Jul. 21, 2009, in counterpart International Application No. PCT/JP2009/057530.

Written Opinion [PCT/ISA/237] issued Jul. 21, 2009, in counterpart International Application No. PCT/JP2009/057530.

Extended European Search Report issued Apr. 18, 2011 in counterpart European Application No. 09731775.4.

Machine Translation of Japanese Document 2005-191282 Jul. 14, 2005.

Non-Final Office Action issued in U.S. Appl. No. 12/937,831 dated Oct. 13, 2011.

Final Office Action issued in U.S. Appl. No. 12/937,831 dated Apr. 23, 2012.

* cited by examiner

PERMANENT MAGNET AND PROCESS FOR PRODUCING PERMANENT MAGNET

TECHNICAL FIELD

The present invention relates to a permanent magnet and a method for manufacturing the permanent magnet.

BACKGROUND ART

In recent years, a reduction in size and weight, an increase in power and an increase in efficiency have been required for permanent magnetic motors used in hybrid cars, hard disk drives or the like. Then, in realizing a reduction in size and weight, an increase in power and an increase in efficiency in the above-mentioned permanent magnetic motors, a reduction in film thickness and further improvement in magnetic characteristics have been required for permanent magnets buried in the permanent magnetic motors. Incidentally, as the permanent magnets, there are ferrite magnets, Sm—Co-based magnets, Nd—Fe—B-based magnets, $Sm_2Fe_{17}N_x$-based magnets and the like. In particular, Nd—Fe—B-based magnets having high coercive force are used as the permanent magnets for the permanent magnet motors.

Here, as a method for manufacturing the permanent magnet, a powder sintering method is generally used. In the powder sintering method as used herein, a raw material is first pulverized with a jet mill (dry pulverization) to produce a magnet powder. Thereafter, the magnet powder is placed in a mold, and press molded to a desired shape while applying a magnetic field from the outside. Then, the solid magnet powder molded to the desired shape is sintered at a predetermined temperature (for example, 1100° C. in the case of the Nd—Fe—B-based magnet), thereby manufacturing the permanent magnet.

Further, in the powder sintering method, when the raw material is pulverized with the jet mill, a slight amount of oxygen is usually introduced into the jet mill to control the oxygen concentration in nitrogen gas or Ar gas as a pulverizing medium to a desired range. This is because a surface of the magnet powder is forced to be oxidized, and the magnetic powder finely pulverized without this oxidation treatment ignites at the same time that it comes into contact with the air. However, most of oxygen in a sintered body obtained by sintering the magnetic powder subjected to the oxidization treatment is combined with a rare-earth element such as Nd to exist as an oxide in a grain boundary. Accordingly, in order to supplement the oxidized rare-earth element, it is necessary to increase the total amount of the rare-earth element in the sintered body. However, when the total amount of the rare-earth element in the sintered body is increased, there is a problem that the saturation magnetic flux density of the sintered magnet is decreased.

Accordingly, patent document 1 (JP-A-2004-250781) discloses a production method of, when a rare-earth magnet raw material is pulverized in a jet mill, recovering the pulverized magnet raw material in a rust preventive oil such as a mineral oil or a synthetic oil to form a slurry, wet molding this slurry in a magnetic field while performing deoiling, subjecting the molded body to deoiling treatment in vacuo, and performing sintering.

BACKGROUND ART DOCUMENTS

Patent Documents

Patent Document 1: JP-A-2004-250781 (Pages 10 to 12, FIG. 2)

SUMMARY OF THE INVENTION

On the other hand, it has been known that the magnetic characteristics of the permanent magnet are basically improved by miniaturizing the crystal grain size of a sintered body, because the magnetic characteristics of the magnet is derived by a single-domain fine particle theory. In general, when the crystal grain size of the sintered body is adjusted to 3 μm or less, it becomes possible to sufficiently improve the magnetic performance.

Here, in order to miniaturize the crystal grain size of the sintered body, it is necessary to also miniaturize the grain size of a magnet raw material before sintering. However, even when the magnet raw material finely pulverized to a grain size of 3 μm or less is molded and sintered, grain growth of magnet particles occurs at the time of sintering. Accordingly, the crystal grain size of the sintered body after sintering has not been able to be reduced to 3 μm or less.

Accordingly, there is considered a method of adding a material for inhibiting the grain growth of the magnet particles (hereinafter referred to as a grain growth inhibitor) to the magnet raw material before sintering. According to this method, it becomes possible to inhibit the grain growth of the magnet particles at the time of sintering, for example, by coating surfaces of the magnet particles before sintering with a grain growth inhibitor such as a metal compound having a melting point higher than a sintering temperature. For example, phosphorus (P) is added as the grain growth inhibitor to a magnet powder in patent document 1. However, when the grain growth inhibitor is added to the magnet powder by allowing it to be previously contained in an ingot of the magnet raw material, as described in the above-mentioned patent document 1, the grain growth inhibitor is not positioned on the surfaces of the magnet particles after sintering, and is diffused into the magnet particles. As a result, the grain growth at the time of sintering cannot be sufficiently inhibited. Further, this has also contributed to a decrease in residual magnetization of the magnet.

The invention has been made in order to solve the above-mentioned conventional problems, and an object of the invention is to provide a permanent magnet in which oxidation of a pulverized magnet raw material can be prevented by mixing the magnet raw material with a rust preventive oil and in which the crystal grain size of the sintered body is adjusted to 3 μm or less to make it possible to improve the magnetic performance, because the grain growth of the magnet particles at the time of sintering can be inhibited by a high-melting metal element-containing organic compound or a precursor of a high-melting ceramic dissolved in the mixed rust preventive oil; and a method for manufacturing the permanent magnet.

Namely, the present invention relates to the following items (1) to (3).

(1) A permanent magnet manufactured by steps of:

pulverizing a magnet raw material into fine particles having a grain size of 3 μm or less;

mixing the pulverized magnet raw material with a rust preventive oil in which a high-melting metal element-containing organic compound or a precursor of a high-melting ceramic is dissolved, thereby preparing a slurry;

compression molding the slurry to form a molded body; and sintering the molded body.

Incidentally, the term "high-melting metal element-containing organic compound" means a compound containing a high-melting metal atom or a high-melting metal ion which forms an ionic bond and/or a covalent bond and/or a coordination bond through an atom, which is generally contained in organic compounds, such as carbon, nitrogen, oxygen, sulfur and phosphorus.

(2) The permanent magnet according to (1), in which the high-melting metal element-containing organic compound or the precursor of the high-melting ceramic is unevenly distributed in a grain boundary of the magnet raw material after sintering.

(3) A method for manufacturing a permanent magnet, including steps of: pulverizing a magnet raw material into fine particles having a grain size of 3 μm or less;

mixing the pulverized magnet raw material with a rust preventive oil in which a high-melting metal element-containing organic compound or a precursor of a high-melting ceramic is dissolved, thereby preparing a slurry;

compression molding the slurry to form a molded body; and sintering the molded body.

According to the permanent magnet having the constitution of the above (1), oxidation of the pulverized magnet raw material can be prevented by mixing the magnet raw material with the rust preventive oil. Further, the grain growth of the magnet particles at the time of sintering can be inhibited by coating the surfaces of the pulverized magnet particles with the high-melting metal element-containing organic compound or the precursor of the high-melting ceramic dissolved in the mixed rust preventive oil. Accordingly, it becomes possible to adjust the crystal grain size of the sintered body to 3 μm or less to improve the magnetic performance.

Further, according to the permanent magnet described in the above (2), the high-melting metal element-containing organic compound or the precursor of the high-melting ceramic is unevenly distributed in the grain boundary of the magnet raw material after sintering, so that it becomes possible to inhibit the grain growth of the magnet particles at the time of sintering without decreasing the residual magnetization of the magnet.

Furthermore, according to the method for manufacturing a permanent magnet described in the above (3), oxidation of the pulverized magnet raw material can be prevented by mixing the magnet raw material with the rust preventive oil. In addition, the grain growth of the magnet particles at the time of sintering can be inhibited by coating the surfaces of the pulverized magnet particles with the high-melting metal element-containing organic compound or the precursor of the high-melting ceramic dissolved in the mixed rust preventive oil. Accordingly, it becomes possible to adjust the crystal grain size of the sintered body to 3 μm or less to improve the magnetic performance.

MODE FOR CARRYING OUT THE INVENTION

A specific embodiment of a permanent magnet and a method for manufacturing the permanent magnet according to the invention will be described below in detail with reference to the drawings.

Constitution of Permanent Magnet

Figure 1:
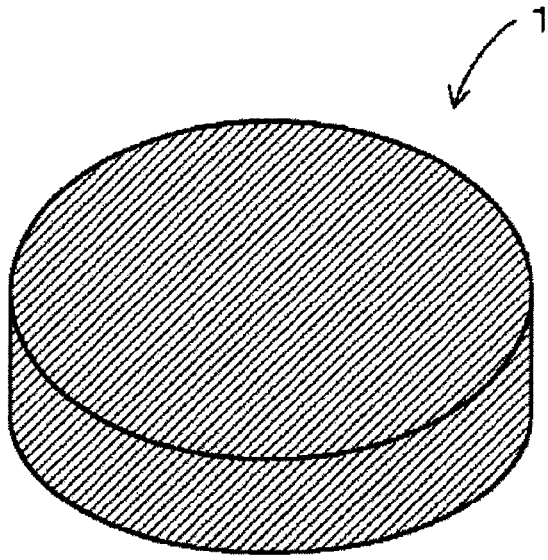
FIG. 1 is an overall view showing a permanent magnet according to the present embodiment.

First, a constitution of a permanent magnet 1 will be described using FIGS. 1 to 3.

The permanent magnet 1 according to this embodiment is a Nd—Fe—B-based magnet. Further, a high-melting metal element-containing organic compound or a precursor of a high-melting ceramic for inhibiting the grain growth of the permanent magnet 1 at the time of sintering is added. Incidentally, the contents of respective components are regarded as Nd: 27 to 30 wt %, a metal component contained in the high-melting metal element-containing organic compound (or a ceramic component contained in the precursor of the high-melting ceramic): 0.01 to 8 wt %, B: 1 to 2 wt %, and Fe (electrolytic iron): 60 to 70 wt %. Furthermore, the permanent magnet 1 according to this embodiment has a cylindrical shape as shown in FIG. 1, but the shape of the permanent magnet 1 varies depending on the shape of a cavity used in molding. FIG. 1 is an overall view showing the permanent magnet 1 according to this embodiment.

Then, the permanent magnet 1 is prepared by pouring an Nd magnet powder mixed with the rust preventive oil to a slurry state as described later into the cavity having a shape corresponding to an outer shape of a molded body to be molded, and sintering the molded article which has been compression molded.

Figure 2:
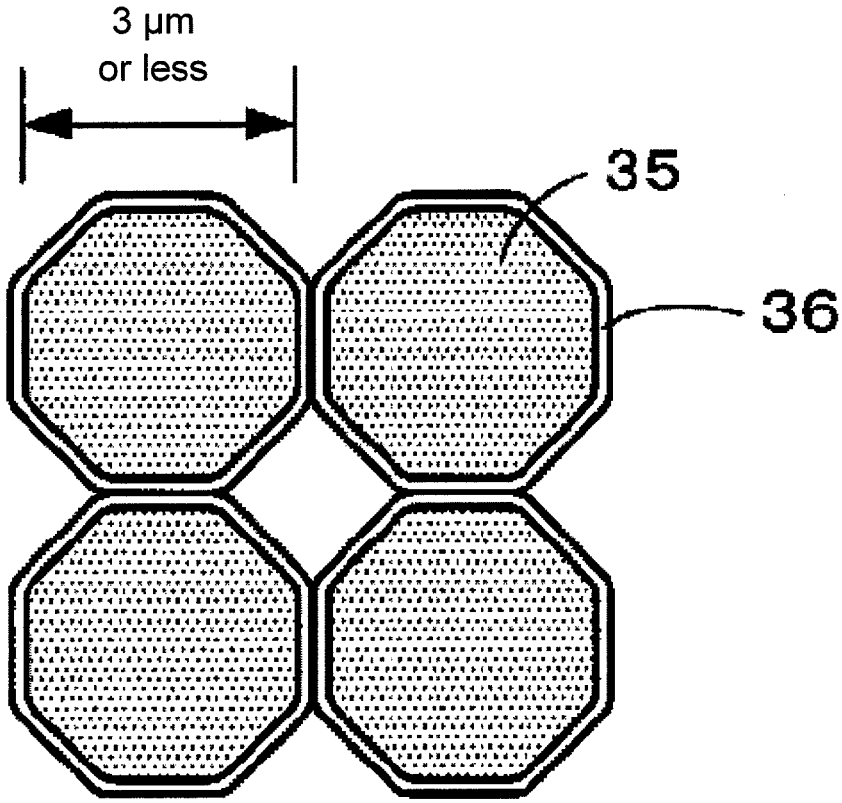
FIG. 2 is an enlarged view showing Nd magnet particles constituting a permanent magnet.

Further, in the permanent magnet 1 according to this embodiment, surfaces of Nd magnet particles 35 constituting the permanent magnet 1 are coated with layers 36 of the high-melting metal element-containing organic compound or the precursor of the high-melting ceramic (hereinafter referred to as grain growth inhibiting layers 36) as shown in FIG. 2. Furthermore, the grain size of the Nd magnet particles 35 is 3 μm or less. FIG. 2 is an enlarged view showing the Nd magnet particles constituting the permanent magnet 1.

And the grain growth inhibiting layers 36 coated on the surfaces of the Nd magnet particles 35 inhibit the grain growth of the Nd magnet particles 35 at the time of sintering. A mechanism of inhibiting the grain growth of the permanent magnet 1 with the grain growth inhibiting layers 36 will be described below using FIG. 3. FIG. 3 is a schematic view showing a magnetic domain structure of a ferromagnetic body.

In general, a grain boundary as a discontinuous boundary face left between a crystal and another crystal has excessive energy, so that grain boundary migration which tends to decrease the energy occurs at high temperature. Accordingly, when sintering of the magnet raw material is performed at high temperature (for example, 1,100 to 1,150° C. for the Nd—Fe—B-based magnet), the so-called grain growth occurs in which small magnet particles contract to disappear and the average grain size of the remaining magnet particles increases.

Here, in this embodiment, when the magnet powder is finely pulverized by wet pulverization as described later, the rust preventive oil in which the high-melting metal element-containing organic compound or the precursor of the high-melting ceramic is dissolved in a slight amount (for example, such an amount that the content of the metal contained in the organic compound or the ceramic component reaches 0.01 to 8 wt % based on the magnet powder). This causes the high-melting metal element-containing organic compound or the precursor of the high-melting ceramic to be uniformly adhered to the particle surfaces of the Nd magnet particles 35 to form the grain growth inhibiting layers 36 shown in FIG. 2, when the magnet powder with which the rust preventive oil has been mixed is sintered thereafter. Further, the melting point of the high-melting metal element-containing organic compound or the precursor of the high-melting ceramic is far higher than the sintering temperature of the magnet raw material (for example, 1,100 to 1,150° C. for the Nd—Fe—B-based magnet), so that the high-melting metal element-containing organic compound or the precursor of the high-melting ceramic can be prevented from being diffused and penetrated (solid-solutionized) into the Nd magnet particles 35 at the time of sintering.

Figure 3:
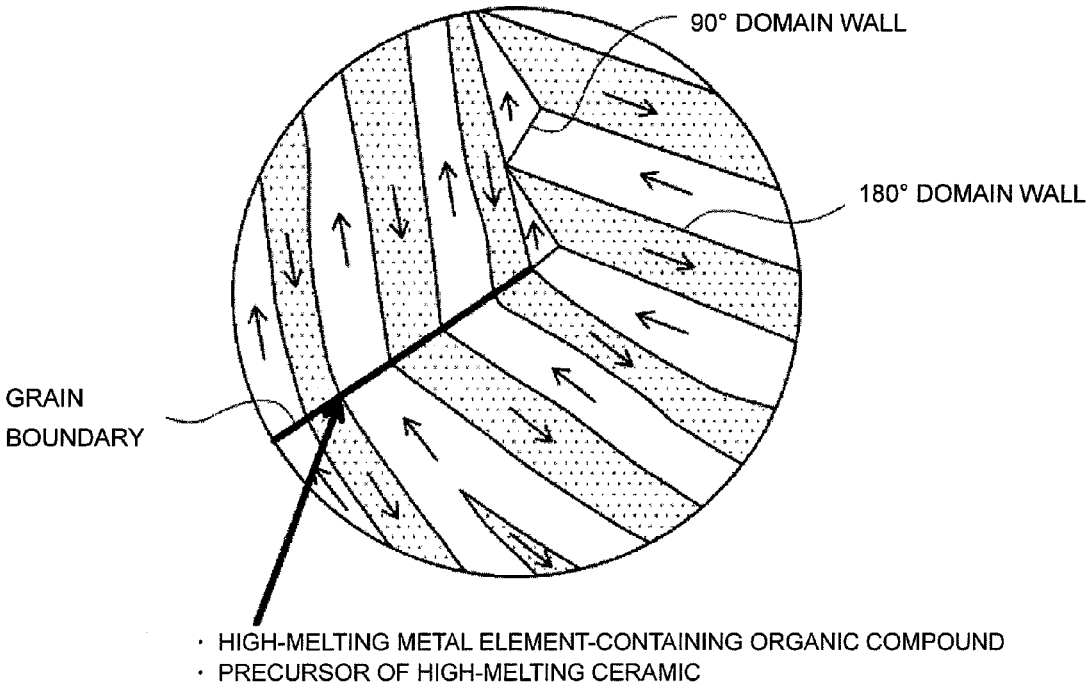
FIG. 3 is a schematic view showing a magnetic domain structure of a ferromagnetic body.

As a result, the high-melting metal element-containing organic compound or the precursor of the high-melting ceramic is unevenly distributed in the boundary face of the magnet particle as shown in FIG. 3. Then, the grain boundary migration which occurs at high temperature is prevented by the high-melting metal element-containing organic compound or the precursor of the high-melting ceramic unevenly distributed, thereby being able to inhibit the grain growth.

On the other hand, it has been known that the magnetic characteristics of the permanent magnet are basically improved by miniaturizing the crystal grain size of the sintered body, because the magnetic characteristics of the magnet is derived by a single-domain fine particle theory. In general, when the crystal grain size of the sintered body is adjusted to 3 μm or less, it becomes possible to sufficiently improve the magnetic performance. Here, in this embodiment, the grain growth of the Nd magnet particles 35 at the time of sintering can be inhibited by the grain growth inhibiting layers 36 as described above. Accordingly, when the grain size of the magnet raw material before sintering is adjusted to 3 μm or less, the grain size of the Nd magnet particles 35 of the permanent magnet 1 after sintering can also be adjusted to 3 μm or less.

Further, in this embodiment, when the magnet powder molded by wet molding is sintered under proper sintering conditions, the high-melting metal element-containing organic compound or the precursor of the high-melting ceramic can be prevented from being diffused and penetrated (solid-solutionized) into the Nd magnet particles 35 as described above. Here, it is known that the diffusion and penetration of the high-melting metal element-containing organic compound or the precursor of the high-melting ceramic into the magnet particles 35 decreases the residual magnetization (magnetization at the time when the intensity of the magnetic field is made zero) of the magnet. Accordingly, in this embodiment, the residual magnetization of the permanent magnet 1 can be prevented from being decreased.

Incidentally, the grain growth inhibiting layer 36 is not required to be a layer composed of only the high-melting metal element-containing organic compound or the precursor of the high-melting ceramic, and may be a layer composed of a mixture of the high-melting metal element-containing organic compound or the precursor of the high-melting ceramic and Nd. In that case, the layer composed of the mixture of the high-melting metal element-containing organic compound or the precursor of the high-melting ceramic and a Nd compound is formed by adding the Nd compound. As a result, liquid-phase sintering of the Nd magnet powder at the time of sintering can be promoted. Incidentally, as the Nd compound to be added, desirable is neodymium acetate hydrate, neodymium (III) acetylacetonate trihydrate, neodymium (III) 2-ethylhexanoate, neodymium (III) hexafluoroacetylacetonate dihydrate, neodymium isopropoxide, neodymium (III) phosphate n-hydrate, neodymium trifluoroacetylacetonate, neodymium trifluoromethanesulfonate or the like.

Method for Manufacturing Permanent Magnet

Figure 4:
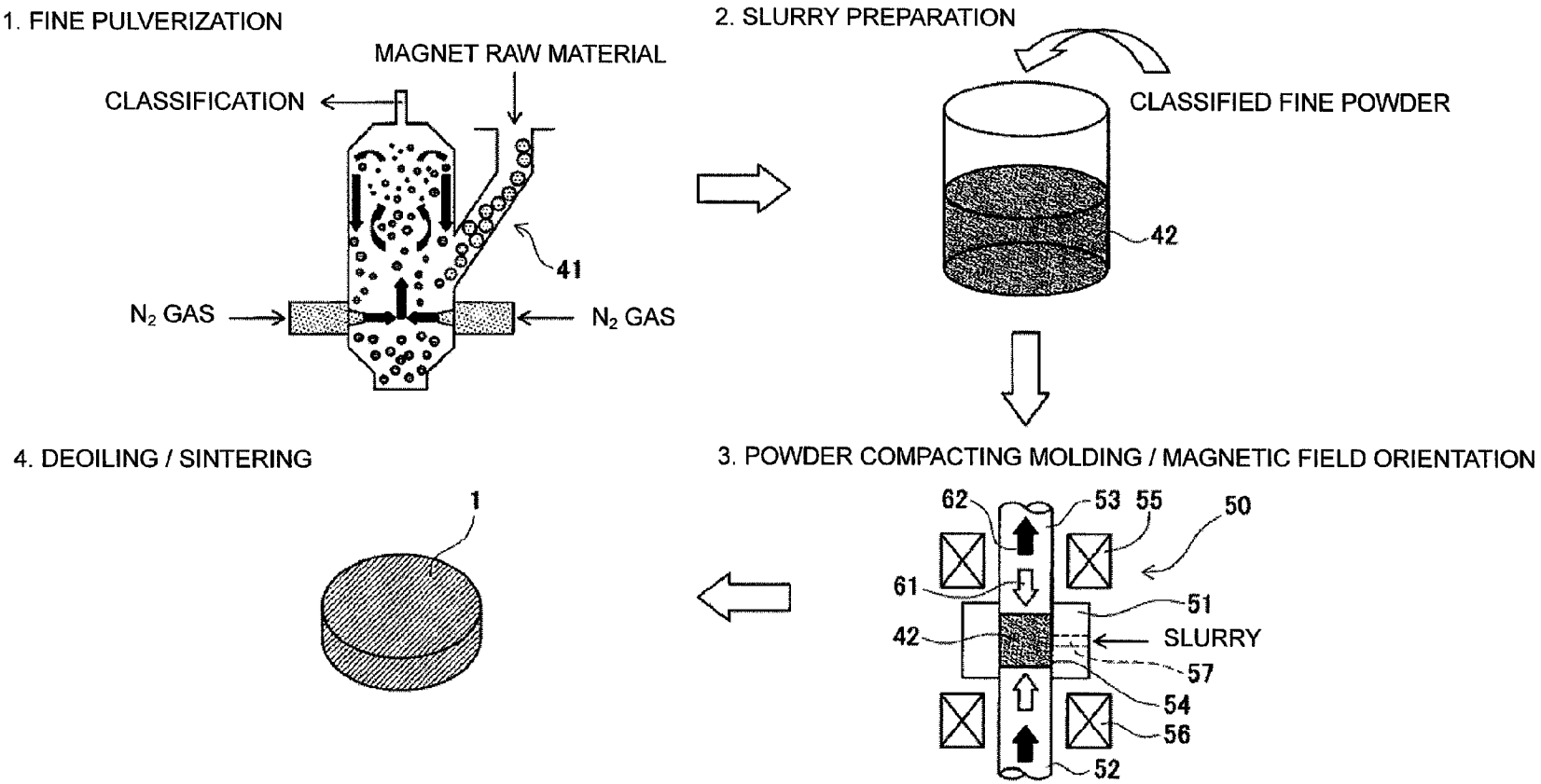
FIG. 4 is an explanatory view showing a manufacturing process of the permanent magnet according to the present embodiment.

A method for manufacturing the permanent magnet 1 according to this embodiment will be described below using FIG. 4. FIG. 4 is an explanatory view showing a manufacturing process of the permanent magnet 1 according to this embodiment.

First, an ingot including, by wt %, 27 to 30% of Nd, 60 to 70% of Fe and 1 to 2% of B is produced. Thereafter, the ingot is crudely pulverized to a size of about 200 μm with a stamp mill, a crusher or the like.

Then, the crudely pulverized magnet powder is finely pulverized with a jet mill 41 in (a) an atmosphere composed of $N_2$ gas and/or Ar gas having an oxygen content of substantially 0% or (b) an atmosphere composed of $N_2$ gas and/or Ar gas having an oxygen content of 0.005 to 0.5%, to form a fine powder having an average grain size of 3 μm or less. Incidentally, the term "an oxygen concentration of substantially 0%" is not limited to the case where the oxygen content is completely 0%, but means that oxygen may be contained in such an amount that an oxide layer is only slightly formed on a surface of the fine powder.

Further, a container containing the rust preventive oil is disposed in a fine powder recovery port of the jet mill 41. Here, as the rust preventive oil, t a mineral oil, a synthetic oil or a mixed oil thereof may be used. Furthermore, the high-melting metal element-containing organic compound or the precursor of the high-melting ceramic is previously added to and dissolved in the rust preventive oil. As the high-melting metal element-containing organic compound or the precursor of the high-melting ceramic to be dissolved, an organic compound of Ta, Mo, W or Nb, or a precursor of BN or AN may be used. More specifically, one soluble in the rust preventive oil is appropriately selected to use from tantalum (V) ethoxide, tantalum (V) methoxide, tantalum (V) tetraethoxyacetylacetonate, tantalum (V) (tetraethoxy) [BREW], tantalum (V) trifluoroethoxide, tantalum (V) 2,2,2-trifluoroethoxide, tantalum tris(diethylamido)-t-butylimide, tungsten (VI) ethoxide, hexacarbonyl tungsten, 12-tungsto (VI) phosphoric acid n-hydrate, tungstosilicic acid n-hydrate, 12-tungsto (VI) silicic acid 26-hydrate, niobium n-butoxide, niobium (IV) chloride-tetrahydrofuran complex, niobium (V) ethoxide, niobium (IV) 2-ethylhexanoate, niobium phenoxide, molybdenum (II) acetate dimer, molybdenum (VI) dioxide bis (acetylacetonate), molybdenum (VI) dioxide bis(2,2,6,6-tetramethyl-3,5-heptanedionate), molybdenum 2-ethylhexanoate, molybdenum hexacarbonyl, 12-molybdo (VI) phosphoric acid n-hydrate, molybdenum (VI) dioxide bis(acetylacetonate), 12-molybdosilicic acid n-hydrate and the like.

Further, the amount of the high-melting metal element-containing organic compound or the precursor of the high-melting ceramic to be dissolved is not particularly limited, but it is preferably adjusted to such an amount that the content of the metal component contained in the organic compound or the ceramic component contained in the precursor of the high-melting ceramic reaches 0.01 to 8 wt % based on the magnet powder.

Successively, the fine powder classified with the jet mill 41 is recovered in the rust preventive oil without exposing to the atmosphere, and the fine powder of the magnet raw material and the rust preventive oil are mixed with each other to prepare a slurry 42. Incidentally, the inside of the container containing the rust preventive oil is brought to an atmosphere composed of $N_2$ gas and/or Ar gas.

Thereafter, the prepared slurry 42 is subjected to powder compacting molding by a molding apparatus 50 to form a predetermined shape. Incidentally, the powder compacting molding includes a dry method in which a dried fine powder is filled in a cavity and a wet method in which a fine powder is slurried with a solvent or the like, and then, filled in a cavity. In this embodiment, the wet method is used.

As shown in FIG. 4, the molding apparatus 50 has a cylindrical mold 51, a lower punch 52 slidable up and down with respect to the mold 51 and an upper punch 53 similarly slidable up and down with respect to the mold 51, and a space surrounded therewith constitutes a cavity 54.

Further, in the molding apparatus 50, a pair of magnetic field generating coils 55 and 56 are disposed in upper and lower positions of the cavity 54, and apply magnetic lines of force to the slurry 42 filled in the cavity 54. Furthermore, the mold 51 is provided with a slurry injection hole 57 which opens to the cavity 54.

And when the powder compacting molding is performed, the slurry 42 is first filled in the cavity 54 through the slurry injection hole 57. Thereafter, the lower punch 52 and the upper punch 53 are driven to apply pressure to the slurry 42 filled in the cavity 54 in a direction of arrow 61, thereby performing molding. Further, at the same time of applying the pressure, a pulsed magnetic field is applied to the slurry 42 filled in the cavity 54 in a direction of arrow 62 parallel to the pressure-applied direction by the magnetic field generating coils 55 and 56, whereby the magnetic field is orientated in a desired direction. Incidentally, it is necessary that the direction in which the magnetic field is orientated is determined, taking into account the magnetic field direction required for the permanent magnet 1 molded from the slurry 42.

Furthermore, the slurry is injected while applying the magnetic field to the cavity 54, and a magnetic field stronger than the initial magnetic field may be applied in the course of the injection or after termination of the injection to perform wet molding. In addition, the magnetic field generating coils 55 and 56 may be disposed so that the pressure-applied direction becomes perpendicular to the magnetic field-applied direction.

Then, a molded body obtained by the powder compacting molding is heated under reduced pressure to remove the rust preventing oil in the molded body. Conditions of heat treatment of the molded body under reduced pressure are a degree of vacuum of 13.3 Pa (about 0.1 Torr) or less, for example, about 6.7 Pa (about $5.0\times10^{-2}$ Torr) and a heating temperature of 100° C. or more, for example, about 200° C. Further, the heating time varies depending on the weight of the molded body or the throughput, but it is preferably 1 hour or more.

Thereafter, sintering of the deoiled molded body is performed. Incidentally, the sintering is performed at a degree of vacuum of 0.13 Pa (about 0.001 Torr) or less, preferably $6.7\times10^{-2}$ Torr (about $5.0\times10^{-4}$ Torr) or less, in the range of 1,100 to 1,150° C. for about 1 hour. Then, as a result of the sintering, the permanent magnet 1 is manufactured.

As described above, in the permanent magnet 1 and the method for manufacturing the permanent magnet 1 according to the invention, the magnet raw material including, by wt %, 27 to 30% of Nd, 60 to 70% of Fe and 1 to 2% of B is dry pulverized with the jet mill into the fine powder having a grain size of 3 μm or less. Then, the pulverized fine powder is mixed with the rust preventive oil in which the high-melting metal element-containing organic compound or the precursor of the high-melting ceramic is dissolved, thereby preparing the slurry 42. The slurry 42 prepared is wet molded, and thereafter deoiled and sintered, thereby manufacturing the permanent magnet 1. Accordingly, oxidation of the pulverized magnet raw material can be prevented by mixing the magnet raw material with the rust preventive oil.

Further, the grain growth of the magnet particles at the time of sintering can be inhibited by coating the surfaces of the pulverized magnet particles with the high-melting metal element-containing organic compound or the precursor of the high-melting ceramic dissolved in the mixed rust preventive oil. Accordingly, it becomes possible to adjust the crystal grain size of the sintered body to 3 μm or less to improve the magnetic performance of the permanent magnet.

Furthermore, the high-melting metal element-containing organic compound or the precursor of the high-melting ceramic is unevenly distributed in the grain boundary of the magnet raw material after sintering, so that it becomes possible to inhibit the grain growth of the magnet particles at the time of sintering without decreasing the residual magnetization of the magnet.

Incidentally, the invention should not be construed as being limited to the above-mentioned example, and it is of course that various improvements and modifications are possible without departing from the gist of the invention.

In addition, the pulverizing conditions, kneading conditions and sintering conditions of the magnet powder should not be construed as being limited to the conditions described in the above-mentioned example.

While the invention has been described in detail with reference to the specific embodiment thereof, it will be apparent to one skilled in the art that various changes and modifications can be made therein without departing from the spirit and scope of the invention.

Incidentally, this application is based on Japanese Patent Application No. 2008-105760 filed on Apr. 15, 2008, the entire contents of which are incorporated herein by reference.

Further, all references cited herein are incorporated by reference in their entirety.

INDUSTRIAL APPLICABILITY

According to the permanent magnet of the invention, oxidation of the pulverized magnet raw material can be prevented by mixing the magnet raw material with the rust preventive oil. Further, the grain growth of the magnet particles at the time of sintering can be inhibited by coating the surfaces of the pulverized magnet particles with the high-melting metal element-containing organic compound or the precursor of the high-melting ceramic dissolved in the mixed rust preventive oil. Accordingly, it becomes possible to adjust the crystal grain size of the sintered body to 3 μm or less to improve the magnetic performance.

DESCRIPTION OF REFERENCE NUMERALS AND SIGNS

1: Permanent magnet
35: Nd magnet particle
36: Grain growth inhibiting layer
42: Slurry

The invention claimed is:

1. A permanent magnet manufactured by steps of:

pulverizing a magnet raw material containing 27 to 30 weight % Nd, 60 to 70 weight % Fe, and 1 to 2 weight % B into fine particles having a grain size of 3 μm or less;

mixing the pulverized magnet raw material with a rust preventive oil in which a high-melting metal element-containing organic compound or a precursor of a high-melting ceramic is dissolved, thereby preparing a slurry;

compression molding the slurry to form a molded body; and sintering the molded body, wherein the high-melting metal element-containing organic compound is an organic compound containing Ta, Mo, W or Nb, and the precursor of a high-melting ceramic is a precursor of BN or AlN, and wherein the high-melting metal element-containing organic compound or the precursor of a high-melting ceramic is uniformly adhered to magnet particles.

2. The permanent magnet according to claim 1, wherein the high-melting metal element-containing organic compound or the precursor of the high-melting ceramic is unevenly distributed in a grain boundary of the magnet raw material after sintering.

3. A method for manufacturing a permanent magnet, comprising steps of:

pulverizing a magnet raw material containing 27 to 30 weight % Nd, 60 to 70 weight % Fe, and 1 to 2 weight % B into fine particles having a grain size of 3 μm or less;

mixing the pulverized magnet raw material with a rust preventive oil in which a high-melting metal element-containing organic compound or a precursor of a high-melting ceramic is dissolved, thereby preparing a slurry;

compression molding the slurry to form a molded body; and sintering the molded body, wherein the high-melting metal element-containing organic compound is an organic compound containing Ta, Mo, W or Nb, and the precursor of a high-melting ceramic is a precursor of BN or AlN, and wherein the high-melting metal element-containing organic compound or the precursor of a high-melting ceramic is uniformly adhered to magnet particles.

* * * * *